US012246871B2

(12) United States Patent
Strand et al.

(10) Patent No.: US 12,246,871 B2
(45) Date of Patent: Mar. 11, 2025

(54) HORIZONTAL FORM, FILL AND SEAL MACHINE AND METHOD OF USING SAME

(71) Applicant: Sargento Foods Inc., Plymouth, WI (US)

(72) Inventors: Aaron Strand, Plymouth, WI (US); James Abston, Plymouth, WI (US)

(73) Assignee: Sargento Cheese Inc., Plymouth, WI (US)

( * ) Notice: Subject to any disclaimer, the term of this patent is extended or adjusted under 35 U.S.C. 154(b) by 0 days.

(21) Appl. No.: 17/483,379

(22) Filed: Sep. 23, 2021

(65) Prior Publication Data

US 2023/0089906 A1 Mar. 23, 2023

(51) Int. Cl.

| | |
|---|---|
| ***B65B 43/04*** | (2006.01) |
| ***B65B 7/02*** | (2006.01) |
| ***B65B 9/08*** | (2012.01) |
| ***B65B 61/06*** | (2006.01) |
| ***B65B 65/00*** | (2006.01) |

(52) U.S. Cl.

CPC ..... *B65B 43/04* (2013.01); *B65B 7/02* (2013.01); *B65B 9/08* (2013.01); *B65B 61/06* (2013.01); *B65B 65/006* (2013.01)

(58) Field of Classification Search

CPC .. B65B 43/04; B65B 7/02; B65B 9/08; B65B 61/06; B65B 65/006; B65B 35/36

See application file for complete search history.

(56) References Cited

U.S. PATENT DOCUMENTS

| | | | | |
|---|---|---|---|---|
| 10,293,966 | B2 | 5/2019 | Garriga Jimenez et al. | |
| 10,351,281 | B2 | 7/2019 | Garriga Jimenez et al. | |
| 10,622,921 | B2 | 4/2020 | Weber et al. | |
| 10,848,047 | B2 | 11/2020 | Weber et al. | |
| 10,994,943 | B2 | 5/2021 | Huber et al. | |
| 11,097,864 | B2 | 8/2021 | Mora Flores et al. | |
| 2002/0152721 | A1* | 10/2002 | Kinigakis | B29C 66/80 53/133.4 |
| 2012/0289391 | A1* | 11/2012 | Murray | B65B 1/02 493/227 |
| 2017/0088298 | A1* | 3/2017 | McLenithan | B65B 41/12 |
| 2019/0375530 | A1 | 12/2019 | Mora Flores et al. | |
| 2020/0047446 | A1 | 2/2020 | Mora Flores | |
| 2020/0130316 | A1 | 4/2020 | Mora Flores | |
| 2021/0155422 | A1 | 5/2021 | Kastinger et al. | |
| 2021/0237981 | A1 | 8/2021 | Huber et al. | |

FOREIGN PATENT DOCUMENTS

| | | | | |
|---|---|---|---|---|
| WO | WO-0110715 A1 * | 2/2001 | ..... | B65B 43/465 |
| WO | WO-2004043684 A1 * | 5/2004 | ..... | B29C 65/203 |

OTHER PUBLICATIONS

Translation of WO/0110715 A1 (Year: 2001).*
D240—PFM D-Series; https://standupbag.guru/en/d240/—(6) pages.
D320—PFM D-Series; https://standupbag.guru/en/d320/—(6) pages.
D400—PFM D-Series; https://standupbag.guru/en/d400/—(5) pages.
D480—PFM D-Series; https://standupbag.guru/en/d480/—(4) pages.
D-EPT Series—PFM D-Series; https://standupbag.guru/en/d-ept-series/—(8) pages.
Bartelt Mag Series FFS-B; https://www.barteltpackaging.com/videos/mag-series-ffs-b/—(2) pages.

* cited by examiner

*Primary Examiner* — Thomas M Wittenschlaeger
(74) *Attorney, Agent, or Firm* — Wong Meyer Smith & McConnell

(57) ABSTRACT

A horizontal form, fill and seal (HFF&S) machine having a different package format in the forming section than in the fill and seal section.

8 Claims, 2 Drawing Sheets

HORIZONTAL FORM, FILL AND SEAL MACHINE AND METHOD OF USING SAME

FIELD OF THE INVENTION

The present subject matter relates to horizontal form, fill and seal (HFF&S) machines.

BACKGROUND OF THE INVENTION

Within a horizontal form, fill and seal (HFF&S) machine, there are two main sections: the forming section and the fill and seal section. The forming section creates a package that has an unsealed top from a web of material. The formed package is then transferred into the fill and seal section so that the package can be filled with a product. Once transferred into the fill and seal section, the package goes through a series of five unit operations: (1) the top of the package is opened, (2) the gusseted bottom of the package is opened, (3) a funnel is inserted into the package interior to direct product into the package and, as product is flowing into the package, the package is flushed with a gas such as nitrogen and/or CO2, (4) after filling, the package is given a second flush with a gas such as nitrogen and/or CO2, and the top of the package is then stretched closed to contain the then modified atmosphere within the package, and (5) the top of the package is hermetically sealed to permanently contain the product in the modified atmosphere.

A HFF&S machine forming and filling one package at a time per machine cycle is referred to as a simplex HFF&S machine. A HFF&S machine forming and filling two packages at a time per machine cycle is referred to as a duplex HFF&S machine. A HFF&S machine forming and filling three packages at a time per machine cycle is referred to as a triplex HFF&S machine. A HFF&S machine forming and filling four packages at a time per machine cycle is referred to as a quadplex HFF&S machine. Currently, and related to an 8 oz or larger package of shredded cheese on a HFF&S machine with a single forming section, there are no HFF&S machine manufacturers offering the capability of forming and filling four packages at a time per machine cycle.

With a conventional HFF&S machine, the forming section will make, cut, and place either one, two or three packages at the same time into the fill and seal section. After being placed, these packages continue on through each unit operation in the fill and seal section in the same format (number of packages) in which they were placed, (i.e., one package at a time for a simplex HFF&S machine, two packages at a time in a duplex HFF&S machine and three packages at a time in the triplex HFF&S machine). Format in the forming section refers to the number of packages formed at the same time per machine cycle. Format in the fill and seal section refers to the number of packages filled at the same time per machine cycle. The same format between the two sections of conventional HFF&S machines is due to the package grippers of the fill and seal section being attached to a common carrier such as an attachment chain, a round turret, or a walking beam. With conventional HFF&S machine technology, the fill and seal section of the machine follows the same format as the forming section, i.e., one package formed and one package filled per machine cycle in a simplex HFF&S machine, two package format in both sections in a duplex HFF&S machine, and three package format in both sections in a triplex HFF&S machine.

For an 8 oz or larger package of shredded cheese on a HFF&S machine, there are no conventional HFF&S machines that form four packages at a time because cutting and placing four packages at a time is not technically feasible since four packages cannot be cantilevered out and effectively cut and transferred to the fill and seal section.

Electromagnetic linear motion technology is being used in the fill and seal section of HFF&S machines. More specifically, this technology has been successfully used in a wash-down environment for only about two or three years now. With this technology, independently controlled carriages, with package grippers, are no longer attached to a common carrier and are capable of moving independent of each other. To date, conventional HFF&S machine manufacturers using this electromagnetic linear motion technology keep the same format after transferring the packages from the forming section into the fill and seal section of the HFF&S machine.

The processing speeds of a HFF&S machine is typically limited by the fill and seal section, and, in most cases, particularly by the unit operation involving filling and flushing the packages. Each type of HFF&S machine can run at a specific number of machine cycles of unit operations per minute, which results in a cycle time per unit operation and results in the yield of packages per minute. For example, conventional processing times for various HFF&S machines which are filling 8 oz packages of shredded cheese are as follows:

- Simplex: 60 cycles per minute\1.0 second cycle time\yielding 60 packages per minute
- Duplex: 55 cycles per minute\1.1 second cycle time\yielding 110 packages per minute
- Triplex: 50 cycles per minute\1.2 second cycle time\yielding 150 packages per minute.

SUMMARY OF THE INVENTION

In one construction, the disclosure provides a horizontal form, fill and seal machine comprising a forming section adapted to form packages in a first format and a fill and seal section adapted to fill and seal packages in a second format different than the first format.

In another construction, the disclosure provides a horizontal form, fill and seal machine comprising a forming section adapted to form packages in one of a one, two and three package format and a fill and seal section adapted to fill and seal packages in a four package format.

In another construction, the disclosure provides a horizontal form, fill and seal machine comprising a forming section adapted to form packages in a two package format and a fill and seal section adapted to fill and seal packages in a four package format.

In another constructions, the disclosure provides a horizontal form, fill and seal machine comprising a forming section adapted to form packages in a three package format and a fill and seal section adapted to fill and seal packages in a four package format.

In another constructions, the disclosure provides a method for use of a horizontal form, fill and seal machine comprising the steps of using the forming section of a horizontal form, fill and seal machine to form packages of a first format and using the fill and seal section of the machine to fill and seal packages in second format different from the first format.

In another construction, the disclosure provides a method for use of a horizontal form, fill and seal machine comprising the steps of using the forming section of a horizontal form, fill and seal machine to form packages having a first cycle time and using the fill and seal section of the machine to fill and seal packages in a second cycle time different than the first cycle time.

In another construction, the disclosure provides a method for use of a horizontal form, fill and seal machine to fill a package with product comprising the steps of using only one forming section to form packages and using only one fill and seal section to open, fill with product, flush and seal packages in a cycle time of at least 1.33 seconds.

Other aspects of the disclosure will become apparent by consideration of the detailed description and accompanying drawings.

DETAILED DESCRIPTION

Before any constructions of the disclosure are explained in detail, it is to be understood that the disclosure is not limited in its application to the details of construction and the arrangement of components set forth in the following description or illustrated in the following drawings. The disclosure is capable of other constructions and of being practiced or of being carried out in various ways.

Figure 1:
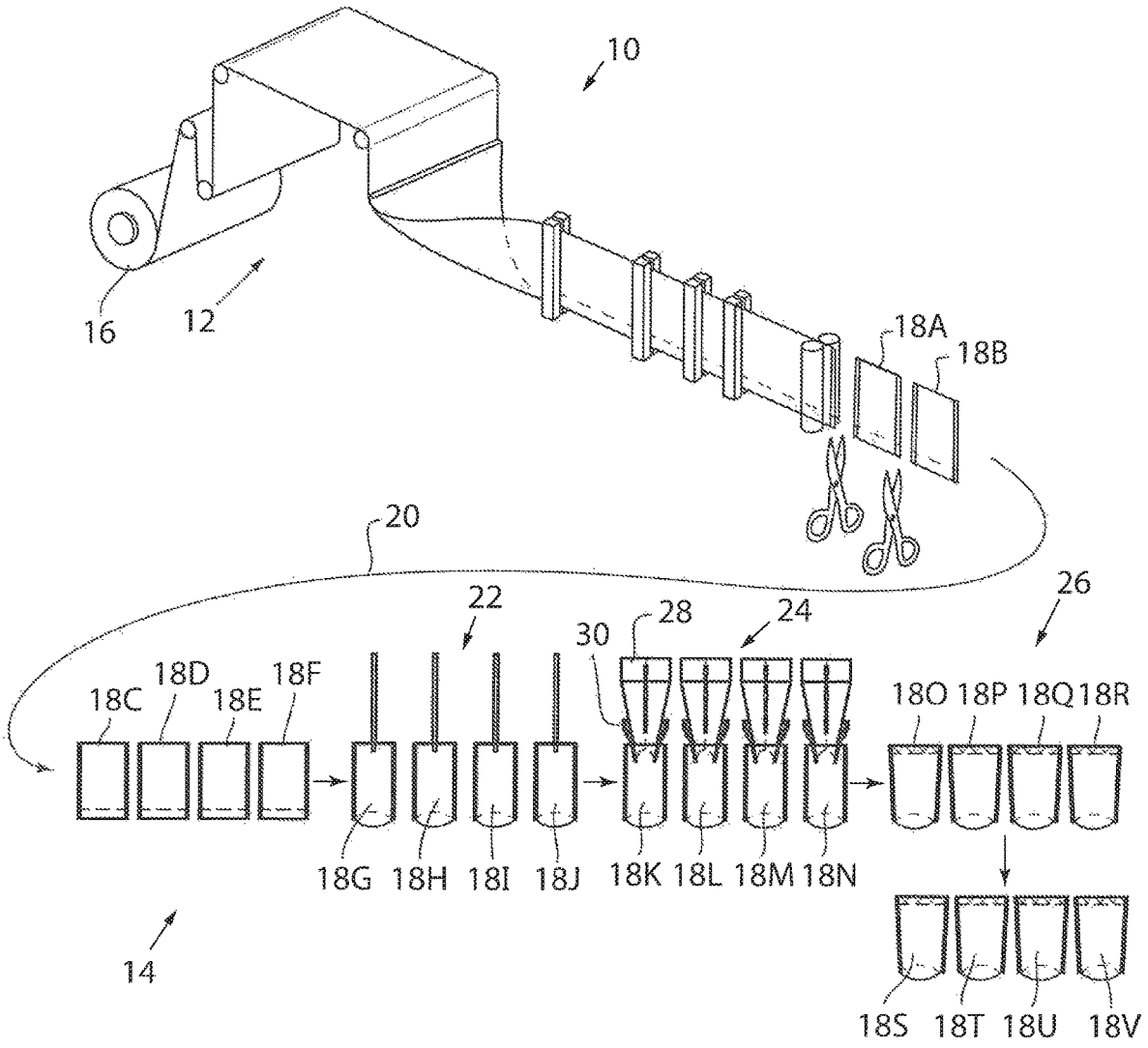
FIG. 1 is a schematic of a HFF&S machine according to a first embodiment of the invention.

With reference to FIG. 1, there is shown schematically a horizontal form, fill and seal (HFF&S) machine 10 in accordance with the present disclosure. The HFF&S machine 10 includes a single forming section 12 and a single fill and seal section 14. The forming section 12 includes a web 16 of package material that is folded, sealed and cut into individual packages 18 as is known in the art. In FIG. 1, the forming section 12 has a two package format in that two packages 18A and 18B are cut at the same time similar to a conventional duplex HFF&S machine. For example, the forming section 12 can operate at approximately 75 cycles per minute with a 0.8 second cycle time thus producing 150 packages a minute.

When packages 18A and 18B are placed into the fill and seal section 14 by the forming section 12, the fill and seal section 14, using electromagnetic linear motion technology 20, such as ACOPOStrak, available from B&R Industrial Automation Corp. of Austria, accumulates two cycles of packages 18A and 18B, to become the packages 18C, 18D, 18E and 18F. The packages 18C, 18D, 18E and 18F are then transported through each unit operation of the fill and seal section 14 preferably using intermittent motion. The fill and seal section 14 opens the tops and gussets of the packages 18G, 18H, 18I and 18J, fills and flushes packages 18K, 18L, 18M and 18N, seals the four packages 18O, 18P, 18Q and 18R, the unit operations as are known in the art, and discharges the four packages 18S, 18T, 18U and 18V. The electromagnetic linear motion technology 20 allows for the fill and seal section 14 to follow a different package format than that used in the forming section 12. For example, a forming section 12 having a one package format is able to feed a fill and seal section 14 having a two package format. Further for example and as shown in FIG. 1, a forming section 12 having a two package format is able to feed a fill and seal section 14 having a four package format.

The four packages are transported together through the five unit operations in the fill and seal section 14. The unit operations are preferably combined into three stations 22, 24 and 26, however, they do not have to be combined. At the package and gusset opening station 22, the four packages 18G, 18H, 18I and 18J have their tops opened and their gussets opened at the same time. At the filling and flushing station 24, the packages 18K, 18I, 18M and 18N have a funnel 28 inserted into the interior of each package to fall each package with a predetermined amount of product, are flushed with a gas from a gas lance 30, have a second gas flushing then are stretched closed. Any type of funnel and gas lance can be utilized such as those shown in U.S. Pat. No. 11,077,972 for example. At the sealing station 26, the packages 18O, 18P, 18Q and 18R are hermetically sealed to permanently contain the product in the modified atmosphere within the package interior. The packages 18S, 18T, 18U and 18V are then discharged from the machine 10. For example, the fill and seal section 14 can operate at approximately 37.5 cycles per minute with a 1.6 second cycle time thus producing 150 packages a minute. It is noted that worth that the HFF&S machine 10 illustrated in FIG. 1 leverages the capabilities of the typical duplex forming section's maximum speed of 75 packages per minute (only a 0.8 second cycle time) but by changing to a four package format in the fill and seal section 14, doubles the cycle time to 1.6 seconds, yet still producing 150 packages per minute.

Increasing or extending the cycle time in the fill and seal section from the conventional 1.1 seconds cycle time of a duplex HFF&S machine, a direct result of changing formats from a two package format in the forming section to a larger package format in the fill and seal section, has many effects and benefits as follows.

First, the five unit operations in the fill and seal section 14 can be combined into three stations 22, 24 and 26 instead of five stations. This allows the HFF&S machine 10 to be only marginally longer than a conventional duplex HFF&S machine but yield approximately 150 packages per minutes rather than the conventional duplex HFF&S of 110 packages per minute. This is particularly important for manufacturing space and maintenance.

Second, radial scale performance, as is known by one of skill in the art, is enhanced due to the increased cycle time in the fill and seal section 14. The three to four scale buckets per package can be staggered to minimize funnel plugs. If a funnel plug occurs, there is extra time to detect a funnel plug and inhibit the next scale dump, thus decreasing product loss. At a conventional 1.1 second cycle time, the next scale dump occurs before there is enough time to detect a funnel plug. The extra cycle time also allows larger packages, such as 16 oz and 24 oz packages, to be filled at the approximately 150 packages per minute rate.

Third, with a longer cycle time in the fill and seal section 14, lower oxygen levels within the package interior can be attained or, alternatively, the same oxygen level can be maintained with less consumption of the flushing gas from lance 30.

The HFF&S machine 10 can produce approximately 150 packages per minute, the same as with a conventional triplex HFF&S, but with only the approximate length of conventional duplex machine and with the advantages of the extended cycle time set forth above.

The packages 18 can be of any volume such as 8 oz, 16 oz or 24 oz for example and still be produced at the approximately 150 packages per minute rate. The product to be filled into the packages can be any type of product such as shredded cheese for example.

Figure 2:
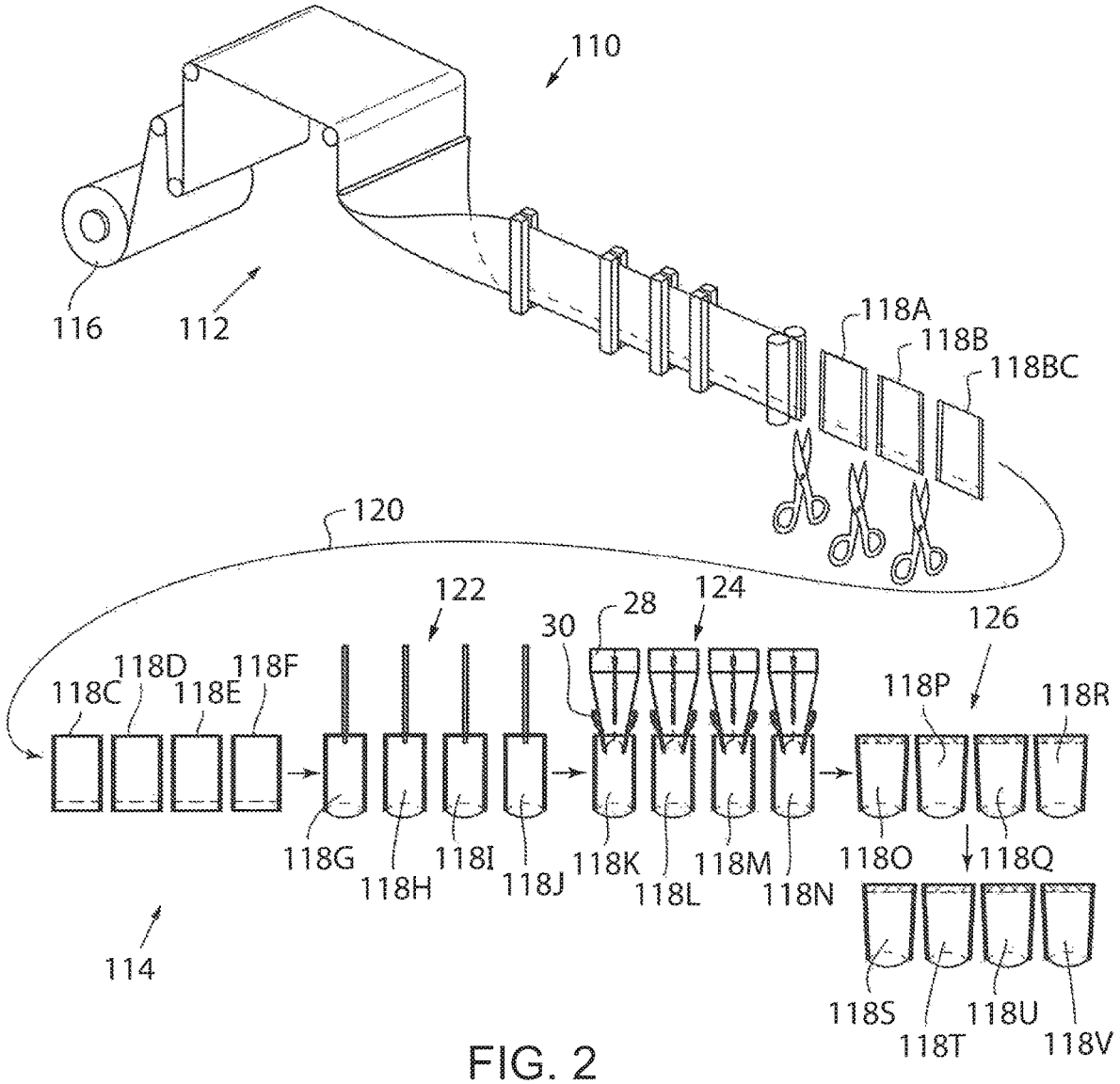
FIG. 2 is a schematic of a HFF&S machine according to a second embodiment of the invention.

Turning to FIG. 2, a second embodiment of a HFF&S machine 110 in accordance with the present disclosure is shown schematically. The HFF&S machine 110 includes a forming section 112 and a fill and seal section 114. The forming section 112 includes a web 116 of package material that is folded, sealed and cut into individual packages 118A, 118B and 118BC. In this second embodiment, the forming section 112 has a three package format in that three packages are cut at the same time per machine cycle, similar to a triplex HFF&S machine. For example, the forming section 112 can operate at approximately 60 cycles per minute with a 1.0 second cycle time thus producing 180 packages a minute.

Using electromagnetic linear motion technology 120 as described above, the packages 118C, 118D, 118E and 118E are then transported through the fill and seal section 114. The fill and seal section 114 opens the tops and gussets of package 118G, 118H, 118I and 118J at the same time, fills and flushes packages 118K, 118L, 118M and 118N at the same time, seals the four packages 118O, 188P, 118Q and 118R at the same time, and discharges packages 118S, 118T, 118U and 118V at the same time. The electromagnetic linear motion technology 120 allows for the fill and seal section 114 to follow a different package format than that used in the forming section 112.

The four packages are transported through the five unit operations which are combined into three stations including the package and gusset opening station 122, the filling and flushing station 124 and the sealing station 124, such stations as were described above with respect to the first embodiment. As such and for example, the fill and seal section 114 can operate at approximately 45 cycles per minute with a 1.33 second cycle time thus producing 180 packages a minute. It is noted that the HFF&S machine 110 illustrated in FIG. 2 leverages the capabilities of the typical triplex forming section's maximum speed of 60 packages per minute (only a 1.0 second cycle time) but by changing to a four package format in the fill and seal section 114, increasing the cycle time to 1.33 seconds, yet still producing 180 packages per minute.

Increasing or extending the cycle time in the fill and seal section 114, a direct result of changing formats from a three package format in the forming section 112 to a four package format in the fill and seal section 114, has the same benefits as described above with respect to the first embodiment.

The HFF&S machine 110 can produce approximately 180 packages per minute but with only the approximate length of conventional triplex HFF&S machine with the advantages of the extended cycle time set forth above.

Various features and advantages of the invention are set forth in the following claims.

What is claimed is:

1. A horizontal form, fill and seal machine comprising:

a single forming line adapted to fully form packages from a web of material by cutting the web to simultaneously separate only a first number of fully formed individual packages ready for filling; and a single fill and seal line operationally connected to and in line with the forming line and adapted to receive the all of the fully formed individual packages and thereafter simultaneously fill and seal only a second number of formed individual packages wherein the second number is different from the first number.

2. A horizontal form, fill and seal machine comprising:

a single forming line adapted to fully form packages from a web of material by cutting the web to simultaneously separate only two fully formed individual packages per machine cycle; and a single fill and seal line operationally connected to and in line with the single forming line and adapted to simultaneously fill and seal only four formed individual packages per machine cycle.

3. A horizontal form, fill and seal machine comprising:

a single forming line adapted to fully form packages from a web of material by cutting the web to simultaneously separate only three fully formed individual packages per machine cycle; and a single fill and seal line operationally connected to and in line with the single forming line and adapted to simultaneously fill and seal only four formed individual packages per machine cycle.

4. A method for use of a horizontal form, fill and seal machine comprising the steps:

using a single forming line of a horizontal form, fill and seal machine to fully form packages from a web of material by cutting the web to simultaneously separate only a first number of fully formed individual packages ready for filling;

transferring all of the fully formed individual packages to a single fill and seal line which is in line with the single forming line using an electromagnetic linear motion conveyor; and using the single fill and seal line of the machine to simultaneously fill and seal only a second number of individual formed packages, wherein the second number is different from the first number.

5. The method of claim 4 wherein electromagnetic liner motion is used to move packages through the fill and seal line.

6. A horizontal form, fill and seal machine comprising:

a forming line adapted to simultaneously form only a first number of formed packages by cutting a web of material per machine cycle; and a single fill and seal line in communication with and in line with the forming line and adapted to simultaneously fill and seal only a second number of formed packages per machine cycle, wherein the second number is greater than the first number.

7. A horizontal form, fill and seal machine comprising:

a forming line adapted to simultaneously form packages by cutting a web of material into only one of one, two and three; and a single fill and seal line in line with the forming line and adapted to simultaneously fill and seal only four formed packages.

8. A method for use of a horizontal form, fill and seal machine comprising the steps:

using forming section of a horizontal form, fill and seal machine to simultaneously form only a first number of packages by cutting a web of material in a first; and using a single fill and seal section of the machine in line with the forming section to simultaneously fill and seal only a second number of the formed packages, wherein the second number is different from the first number.

* * * * *